US008092250B2

(12) United States Patent
Alami

(10) Patent No.: US 8,092,250 B2
(45) Date of Patent: Jan. 10, 2012

(54) ELECTRICAL CONNECTION DEVICE WITH LIGHT INDICATOR

(75) Inventor: Mounim Houir Alami, Paris (FR)

(73) Assignee: Societe d'Exploitation des Procedes Marechal (SEPM), Saint-Maurice Cedex (FR)

( * ) Notice: Subject to any disclaimer, the term of this patent is extended or adjusted under 35 U.S.C. 154(b) by 0 days.

(21) Appl. No.: 13/109,644

(22) Filed: May 17, 2011

(65) Prior Publication Data

US 2011/0223801 A1 Sep. 15, 2011

Related U.S. Application Data

(63) Continuation of application No. 12/516,697, filed as application No. PCT/FR2007/001950 on Nov. 28, 2007, now Pat. No. 7,967,630.

(30) Foreign Application Priority Data

Nov. 29, 2006 (FR) ..... 06 10427

(51) Int. Cl.
*H01R 12/00* (2006.01)

(52) U.S. Cl. ..... 439/490; 439/38

(58) Field of Classification Search ..... 439/490, 439/489, 38

See application file for complete search history.

(56) References Cited

U.S. PATENT DOCUMENTS

| | | | | |
|---|---|---|---|---|
| 5,081,627 | A | 1/1992 | Yu | |
| 5,244,409 | A | 9/1993 | Guss et al. | |
| 5,829,987 | A * | 11/1998 | Fritsch et al. | 439/38 |
| 6,183,264 | B1 * | 2/2001 | Harsanyi | 439/38 |
| 6,433,445 | B1 | 8/2002 | Ahladas et al. | |
| 6,577,243 | B1 | 6/2003 | Dannenmann et al. | |
| 6,826,369 | B1 | 11/2004 | Bondarev et al. | |
| 6,897,370 | B2 * | 5/2005 | Kondo et al. | 136/243 |
| 2002/0097546 | A1 | 7/2002 | Weinberger | |
| 2005/0136731 | A1 * | 6/2005 | Brown et al. | 439/490 |
| 2006/0234564 | A1 | 10/2006 | Pharn et al. | |
| 2008/0166914 | A1 | 7/2008 | Buzil et al. | |

FOREIGN PATENT DOCUMENTS

| | | |
|---|---|---|
| CA | 2 265 137 | 3/1999 |
| WO | 00/72407 | 11/2000 |

* cited by examiner

*Primary Examiner* — Hien Vu

(74) *Attorney, Agent, or Firm* — Greenblum & Bernstein, P.L.C.

(57) ABSTRACT

An electric connection device including a first connection member to be powered by an electric current and a second conjugated connection member, the first connection member being provided with at least one luminous member having at least two states and powered by a portion of the supply current of said first connection member. The device includes a position sensor having two states and provided in the first connection member so as to be actuated by a portion of the second connection member, or a mobile portion of the first connection member driven by a portion of said second member when said members are in a connection position, thus switching the position sensor from state to the other, the latter being adapted to switch the luminous element or one of them from one state to the other depending on its own state.

8 Claims, 3 Drawing Sheets

ELECTRICAL CONNECTION DEVICE WITH LIGHT INDICATOR

CROSS REFERENCE TO RELATED APPLICATIONS

The present application a continuation application of U.S. application Ser. No. 12/516,697 filed Nov. 28, 2007, which is a U.S. National Stage of International Application No. PCT/FR2007/001950 filed Nov. 28, 2007, published as WO 2008/071881 A3 on Jun. 19, 2008, the disclosures of which are expressly incorporated by reference herein in their entireties. Further, this application claims priority under 35 U.S.C. §119 and §365 of French Application No. 0610427 filed Nov. 29, 2006.

BACKGROUND OF THE INVENTION

1. Field of the Invention

This invention relates to an electrical connection device with an indicator light, comprising a first connection member intended to be powered by an electric current and a second mating connection member, each provided with electrical contacts intended to cooperate with one another in a connection position, once said members have been coupled together following at least one relative translational movement.

2. Background Description

It is known to produce electrical connection devices of this type the electrically powered member of which consists, for example, of a socket outlet, or else the portable socket for an extension cord or a connector, while the other member can be a stationary connector socket or be provided with a grip in order to form a plug.

The electrical connection of these two members is obtained, as already stated, in a connection position, after coupling has been carried out, while generally passing through an intermediate position over the course of the coupling operation, which is referred to as the rest position, in which the two members are fastened together even though there is still no connection between the respective contacts thereof.

It is very useful to be able to easily detect if the device is indeed in the connection position or simply in an intermediate position, e.g., such as the rest position.

Mechanical mechanisms have already been used to display the relative positions of the two members so as to be able to detect the connection position.

However, these mechanisms enable displaying only under the condition of being within proximity to the device, and this results in the likelihood of confusion.

In some known devices, generally only the connected and power-supplied position is displayed by an indicator light. In certain other more sophisticated devices, there may be several separate indicators. In this known art, which is generally based on an analysis of the current, it is therefore in particular not possible to be capable of easily displaying a non-connected rest position while there is one live member.

For example, the device described in the document U.S. Pat. No. 5,244,409 is also known, in which the first connection member can be provided with at least one illuminated member which has at least two states and which is powered by a portion of the supply current of said first connection member whereby it switches from one state to another depending on whether the first connection member is powered or not, or whether said connection members are in the connection position, respectively, whereby the illuminated member or members, based on the states thereof, make it possible to display, on the one hand, the electrical powering or not of the first connection member, which is or is not coupled with the second connection member, and, on the other hand, to separately display the connection and live position of the connection members.

However, in this known device, in order to display a connection position with a charging current, a control device must be operated and the indicators function only as a result of the connection of the contacts themselves and without any interaction between one indicator and another.

SUMMARY OF THE INVENTION

This is why the inventor has conceived of a device of the aforesaid type, i.e., comprising two connection members the first current-supplied member of which is already provided with at least one illuminated member having two states, but which is particularly remarkable in that it comprises a position sensor which has two states and which is arranged inside the first connection member so as to be actuated by a portion of the second connection member, or a movable portion of the first connection member driven by a portion of said second member when said members are in the connection position, causing said sensor to switch from one state to the other, while the latter, according to its own state, is designed to cause the or one of the illuminated members to switch from one state to the other.

According to one embodiment, the position sensor is an electromechanical mechanism which comprises a contactor which is mechanically actuated directly by said portion of the second connection member, or by the movable portion of the first connection member driven by the portion of said second member.

According to another embodiment, the position sensor is a magnetic mechanism which is actuated by a mating magnetic mechanism arranged on said portion of said second connection member, or on the movable portion of said first connection member driven by said portion of the second member.

According to one embodiment, two separate illuminated members each having two states are provided for displaying, on the one hand, the powering or non-powering of the first connection member, and, on the other hand, the connection and live position of the two connection members, respectively, while the position sensor acts not only on the state of the illuminated member for displaying the connection position, but also concomitantly on the illuminated member for displaying the powering or non-powering of the first connection member, in order to cause them to switch from one state to the other when said position sensor is actuated in the connection position.

In this case, for example, the two states of each illuminated member are ON or OFF, respectively, and the two illuminated members have different colours.

According to another embodiment, the illuminated member for displaying the connection position is the same as the illuminated member for displaying the powering or non-powering of the first connection member, said illuminated member having three states and switching from a first state to a second state when the first connection member is supplied with a current, and from this second state to the third state when it is controlled by the position sensor.

In this case, for example, the three states of the common illuminated member are OFF and ON, respectively, according to two separate colours, said illuminated member switching from one colour to the other when it is controlled by the position sensor and when the first connection member is supplied with a current.

According to one alternative, the three states of the common illuminated member are OFF, FLASHING and CONTINUOUSLY ILLUMINATED, respectively, said illuminated member switching from the flashing state to the continuously illuminated state when it is controlled by the position sensor and when the first connection member is supplied with a current.

The illuminated display member(s) is (are) advantageously arranged on the first connection member while comprising a single indicator provided with one or more illuminated members.

BRIEF DESCRIPTION OF THE DRAWINGS

The invention will be well understood upon reading the following description which refers to the appended drawings, in which.

DETAILED DESCRIPTION OF THE INVENTION

Figure 1:
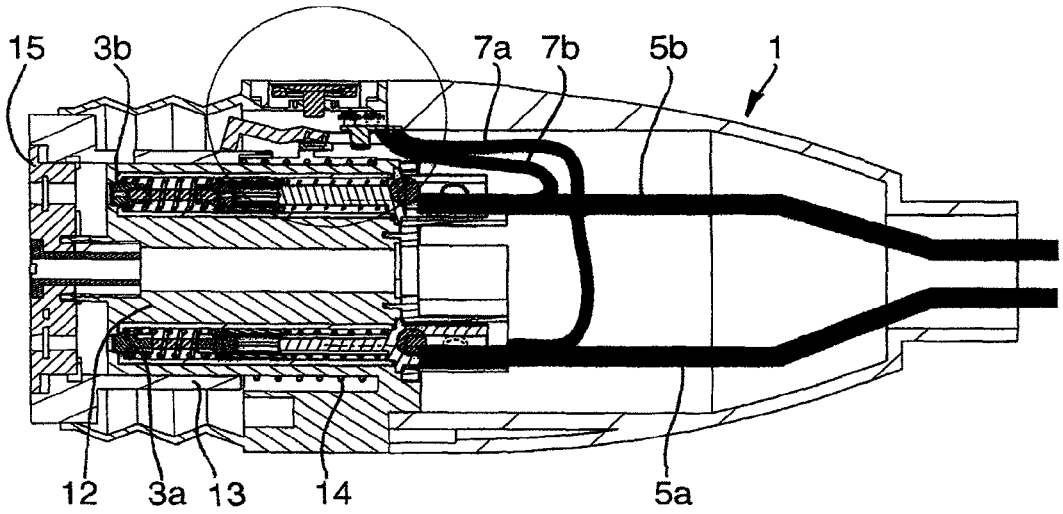
FIG. 1 shows a longitudinal section along I-I of FIG. 3 of a first connection member according to the invention, which, in this case, in the non-limiting form of a portable socket for an extension cord.
Figure 2:
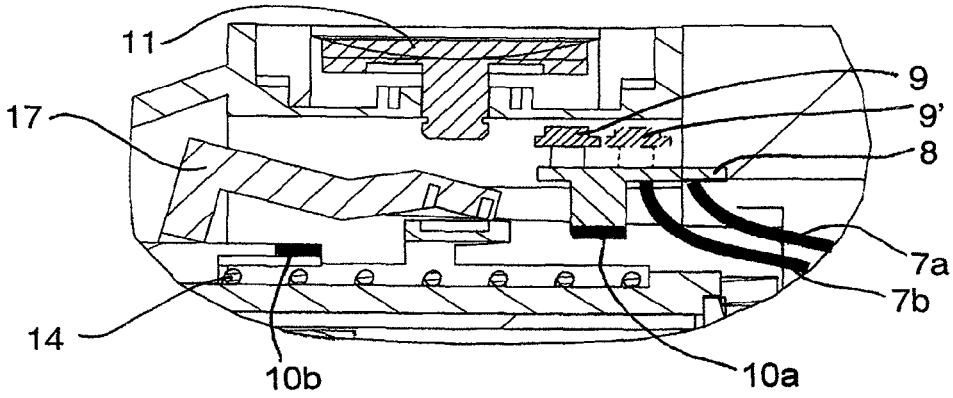
FIG. 2 is enlarged view of the detail encircled in FIG. 1.
Figure 3:
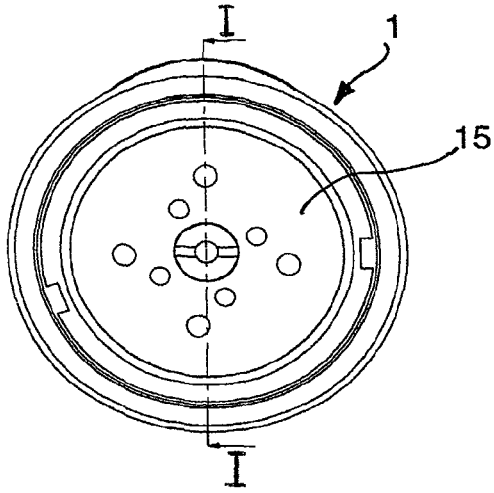
FIG. 3 is an end view of FIG. 1.
Figure 4:
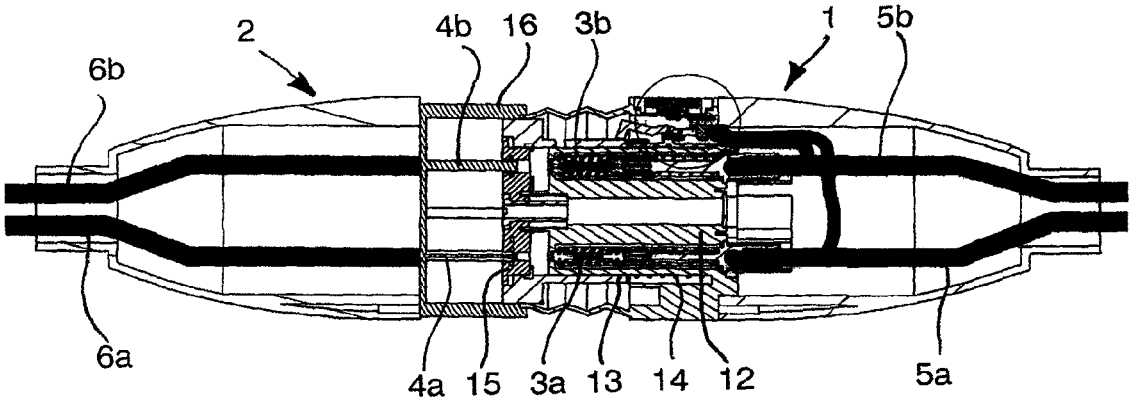
FIG. 4 shows a longitudinal section of an extension cord according to the invention, which is provided with a portable socket according to FIG. 1 and a plug, the two members being shown as partially coupled together, in the rest position.
Figure 5:
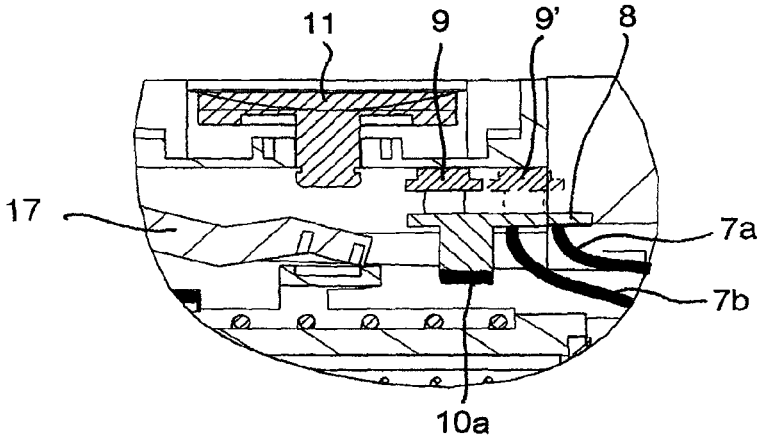
FIG. 5 is an enlarged view of the detail encircled in FIG. 4, FIGS. 6 and 7 correspond to FIGS. 4 and 5, respectively, the two members being shown, however, in the connection position.
Figure 6:
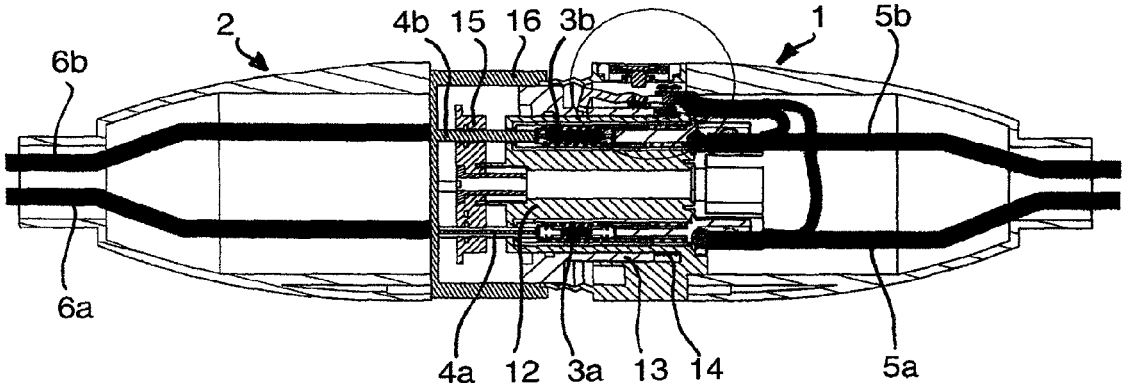

FIGS. 1 to 7 show a portable socket 1 for an extension cord, which is intended to cooperate with a plug 2, the socket like the plug each forming a grip (FIGS. 4 and 6).

The socket 1 and the plug 2 are each provided with contacts, which in this case, for example, are in the form of end contacts, such as contacts 3*a*, 3*b*, for the socket, as shown in the drawings, and pins, such as 4*a*, 4*b*, for the plug (the number of contacts being separate from the invention).

Contacts 3*a*, 3*b* could be sockets rather than end contacts, so as to form so-called pin and socket contacts, the invention being separate from the nature of the contacts.

The contacts 3*a*, 3*b* for the socket are supplied with current via electric cables 5*a*, 5*b*.

The pin contacts 4*a*, 4*b* for the plug are likewise hooked up to electric cables 6*a*, 6*b*, which are themselves intended to be hooked up to an apparatus or device to be supplied with current.

Figure 7:
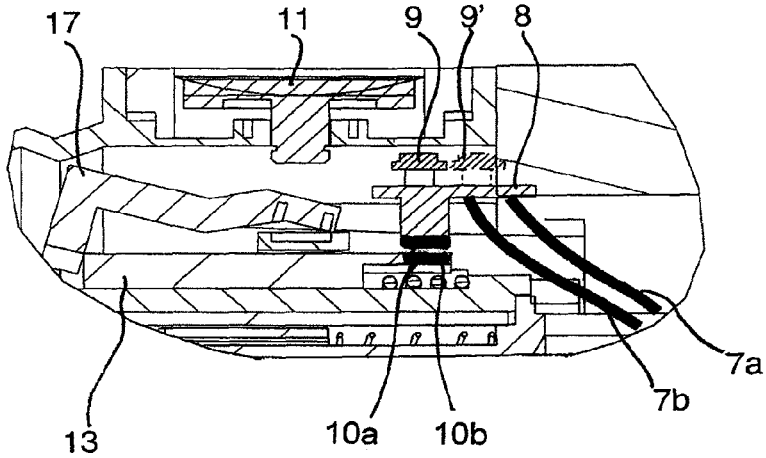

As clearly shown in the figures, and in particular the detail FIGS. 5 and 7, the power cables 5*a*, 5*b* for the socket are provided with branch circuits 7*a*, 7*b*, respectively, which are connected in order to power a printed circuit.

The printed circuit 8 is further provided with a diode 9 and a position sensor 10*a*, which, in this case, is in the form of a magnetic mechanism which will be discussed herein below.

The diode 9 is turned outwardly underneath a translucent element, so as to form an indicator light together with the diode 9.

As shown clearly in the drawings, contacts 3*a*, 3*b* are also mounted inside an insulating block 12 which, in this case, is surrounded by a sleeve 13 mounted free in translation and provided with an elastic recall mechanism which, in this case, is in the form of a spring 14.

As clearly shown in the drawings, after sliding in opposition to the spring 14, the sleeve 13 is arranged so as to be capable of actuating the sensor 10*a*, a will be explained herein below.

Furthermore, in this case, a conventional rotating safety disc 15 has been provided.

As clearly shown in FIGS. 4 and 6, the plug 2 is here provided with an outer casing 16.

Coupling of the plug and socket is carried out in several movements and, in particular, for example, by a first translational movement over the course of which the pins 4*a*, 4*b* of the plug are inserted into openings in the safety disc, and then by a rotating movement which enables said pins 4*a*, 4*b* to be brought into alignment with the contacts 3*a*, 3*b* of the socket (position of FIG. 4), and finally by a last translational movement in order to ensure a connection position of the pins and socket contacts (FIG. 6).

A mechanism for guiding and holding the plug and the socket are obviously provided (e.g., such as the hook 17 intended to lock the sleeve 13 into position), however, like the various coupling movements, these are separate from the invention, except here, however, for the last translational movement making it possible to arrive at the connection position shown in FIGS. 6 and 7.

Therefore, it is understood that, after a partial coupling, as shown in FIG. 6, which thus shows an intermediate position referred to as a rest position, in which there is still no connection between the contacts, the casing 16 for the plug or any other member integral with said plug, comes into contact with a portion of the sleeve 13.

By continuing with a translational movement of the plug, the sleeve 13 is driven to assume the connection position shown in FIGS. 6 and 7, in which the end of said sleeve 13 actuates the sensor 10*a* (FIG. 7) with the assistance of a mating magnetic mechanism 10*b*, such as a magnet, with which it is provided at the end thereof.

Separation of the plug and the socket results in a return of the sleeve 13 to the initial position thereof, under the influence of the spring 14.

As already stated, it is perfectly understood that any other portion or member attached or joined to the plug can be designed to act on the sleeve 13 over the course of this translational movement.

Furthermore, said sleeve 13 could be a movable member of another type.

Finally, a portion of the plug, such as the casing 16, could act directly on the sensor 10*a* by being provided with a mechanism 10*b* in this example.

For example, the magnetic sensor 10*a* could be replaced with an electromechanical mechanism such as a contactor, which could then be mechanically actuated directly by the end of element 13 or element 16.

In summary, depending on the embodiment chosen, the sensor 10*a* (magnetic, electromagnetic or other) can thus be actuated, either by a movable member of the socket, stressed by a stationary member of the plug, or directly by a stationary member of the plug.

The printed circuit 8, which is connected to cables 5*a*, 5*b* by the shunt circuit 7*a*, 7*b*, is such that it powers the diode 9 when the socket is supplied with a current, the diode taking on a green (or other) colour, thereby displaying that the socket is alive.

In the connection position (FIGS. 6 and 7), the sensor 10*a* acts on the printed circuit 8 so as to cause the diode to switch to another state, the diode then taking on a red (or other) colour, for example.

Diodes do indeed exist which take on a different colour, depending on the supply voltage.

According to the embodiment chosen, it is of course also possible to cause the diode 9 to switch from a flashing state to a continuously illuminated state.

According to another embodiment, two diodes are provided (a diode 9 and a diode 9' shown by dotted lines in the figures) one 9 of which functions in the manner previously described, but by taking on a single colour, e.g., a green (or other) colour, when the socket is powered, while the sensor 10*a*, when actuated, enables the other diode 9' to be illuminated with another colour, e.g., red, while at the same time turning off the first diode 9.

In this first example, the two diodes are arranged as shown in the drawings, beneath the same translucent element 11, in order to form a single indicator.

Whether there are one or two diodes, it is understood that the indicator formed by element 11 and said diodes can thus assume three states, namely: OFF, when the socket is not powered, ON, with a certain colour (or flashing), when the socket is powered but in the non-connected (e.g., rest) position, and ON, with a certain colour (or continuously illuminated) when the device is in the connection position.

In the example shown, the translucent element 11, in this case, further comprises an actuating button intended to act on the hook 17 in order to unlock the connection position, however, of course, the translucent element could be completely separate from said button.

Although the embodiments are described with diodes, any other illuminated device can, of course, be anticipated.

What is claimed is:

1. Electrical connection device comprising:

a first connection member structured and arranged to be supplied with an electric current; and a second mating connection member, wherein each of the first connection member and the second connection member are provided with electrical contacts intended to cooperate with one another in a connection position, once said members have been coupled together following a relative translational movement, wherein the first connection member is provided with at least one illuminated member which has at least two states and which is powered by a portion of the supply current of said first connection member, a position sensor being arranged inside the first connection member in order to cooperate with the second connection member, when said members are in the connection position, so as to act on the at least one illuminated member in order to display said connection and alive position of the connection members, wherein said at least one illuminated member switches from one state to another depending on whether the first connection member is powered or not, regardless of the position of the connection members, and wherein the position sensor has two states, and is structured and arranged so as to be actuated by a portion of the second connection member, or a movable portion of the first connection member driven by a portion of said second member, when said members are in the connection position, causing said position sensor to shift from a first state to a second state, the position sensor being further structured and arranged, according to its own state, to cause the at least one illuminated member to switch from the first state to the second state, whereby the at least one illuminated member, depending on the states thereof, provides a display of the electrical powering or non-powering of the first connection member, which is or is not coupled with the second connection member, and separately displays the connection and live position of the connection members, and wherein the at least one illuminated member comprises a common illuminated member for displaying the connection position, which is the same as the at least one illuminated member for displaying the powering or non-powering of the first connection member, said common illuminated member having three states and switching from the first state to the second state when the first connection member is supplied with a current, and from the second state to a third state when the first connection member is controlled by the position sensor.

2. Electrical connection device of claim 1, wherein the position sensor is an electromechanical mechanism which comprises a contactor mechanically actuated directly by said portion of the second connection member, or by a movable portion of the first connection member driven by the portion of said second member.

3. Electrical connection device of claim 1, wherein the position sensor is a magnetic mechanism which is actuated by a mating magnetic mechanism arranged on said portion of the second connection member, or on the movable portion of the first connection member driven by said portion of the second member.

4. Electrical connection device as claimed in claim 1, wherein the at least one illuminated member comprises two illuminated members, each illuminated member having two states, wherein the two illuminated members are structured and arranged for displaying the powering or non-powering of the first connection member, and the connection and live position of the two connection members, respectively, while the position sensor acts on the state of one of the illuminated members for displaying the connection position, and also concomitantly on the other illuminated member for displaying the powering or non-powering of the first connection member, in order to cause the two separate illuminated members to switch from one state to the other when said position sensor is actuated in the connection position.

5. Electrical connection device of claim 4, wherein the two states of each illuminated member are OFF and ON, respectively, and in that the two illuminated members have different colors.

6. Electrical connection device of claim 1, wherein the three states of the common illuminated member are OFF and ON, respectively, according to two separate colors, said illuminated member switching from one color to the other when the first connection member is controlled by the position sensor and when the first connection member is supplied with a current.

7. Electrical connection device of claim 1, wherein the three states of the common illuminated member are OFF, FLASHING and CONTINUOUSLY ILLUMINATED, respectively, said illuminated member switching from the flashing state to the continuously illuminated state when the illuminated member is controlled by the position sensor and when the first connection member is supplied with a current.

8. Electrical connection device as claimed in claim 1, further comprising a single indicator arranged on the first connection member wherein the at least one illuminated member is arranged on the first connection member beneath the single indicator.

* * * * *